US011913368B2

(12) United States Patent
Datz et al.

(10) Patent No.: US 11,913,368 B2
(45) Date of Patent: Feb. 27, 2024

(54) EXHAUST GAS TREATMENT ARRANGEMENT

(71) Applicant: Purem GmbH, Neunkirchen (DE)

(72) Inventors: Wolfgang Datz, Tuebingen (DE); Felix Neumann, Aichwald (DE)

(73) Assignee: Purem GmbH, Neunkirchen (DE)

( * ) Notice: Subject to any disclaimer, the term of this patent is extended or adjusted under 35 U.S.C. 154(b) by 0 days.

(21) Appl. No.: 18/187,800

(22) Filed: Mar. 22, 2023

(65) Prior Publication Data

US 2023/0304431 A1 Sep. 28, 2023

(30) Foreign Application Priority Data

Mar. 22, 2022 (DE) ..... 10 2022 106 603.7

(51) Int. Cl.
*F01N 13/18* (2010.01)
*F01N 3/28* (2006.01)

(52) U.S. Cl.
CPC ..... *F01N 3/2875* (2013.01); *F01N 3/2864* (2013.01); *F01N 13/1827* (2013.01)

(58) Field of Classification Search
CPC .... F01N 3/2842; F01N 3/2864; F01N 3/2875; F01N 13/1827
See application file for complete search history.

(56) References Cited

U.S. PATENT DOCUMENTS

| | | | | |
|---|---|---|---|---|
| 4,142,864 A | 3/1979 | Rosynsky et al. | | |
| 5,332,609 A * | 7/1994 | Corn | F01N 3/2864 | 428/920 |
| 2014/0212340 A1 * | 7/2014 | Saiki | D06H 7/00 | 26/7 |

FOREIGN PATENT DOCUMENTS

| | | | |
|---|---|---|---|
| CN | 109356701 A | 2/2019 | |
| CN | 112594038 A | 4/2021 | |
| DE | 25 25 660 A1 | 12/1975 | |
| DE | 28 23 549 A1 | 12/1978 | |
| DE | 36 32 059 C1 | 3/1988 | |
| DE | 38 36 626 A1 | 5/1990 | |
| DE | 10151494 A1 * | 4/2003 | B01J 35/04 |
| EP | 1 342 888 A1 | 9/2003 | |
| GB | 1 507 164 A | 4/1978 | |
| JP | 55-109716 A | 8/1980 | |
| JP | S57-165618 A | 10/1982 | |
| KR | 20020053130 A | 7/2002 | |

* cited by examiner

*Primary Examiner* — Jonathan R Matthias
(74) *Attorney, Agent, or Firm* — Walter Ottesen, P.A.

(57) ABSTRACT

An exhaust gas treatment arrangement for an exhaust gas system of an internal combustion engine includes a housing which is elongated in the direction of a housing longitudinal axis, and at least one exhaust gas treatment unit which is arranged in the housing and has a shell. At least one bearing/sealing unit with at least two bearing/sealing rings is arranged in a radial intermediate space formed between the shell and the housing. The at least two bearing/sealing rings follow one another radially, are nested inside one another and are each interrupted in a circumferential interruption region. The circumferential interruption region of at least one of the bearing/sealing rings is offset in the circumferential direction with respect to a circumferential interruption region of another one of the bearing/sealing rings.

10 Claims, 3 Drawing Sheets

EXHAUST GAS TREATMENT ARRANGEMENT

CROSS-REFERENCE TO RELATED APPLICATIONS

This application claims priority of German patent application no. 10 2022 106 603.7, filed Mar. 22, 2022, the entire content of which is incorporated herein by reference.

TECHNICAL FIELD

The present disclosure relates to an exhaust gas treatment arrangement for an exhaust gas system of an internal combustion engine.

BACKGROUND

In the case of exhaust gas treatment arrangements for exhaust gas systems of internal combustion engines, it is known for one or more exhaust gas treatment units such as, for example, catalytic converters or particulate filters, to be inserted as prefabricated assemblies into a housing, elongated in the direction of a housing longitudinal axis, of an exhaust gas treatment unit of this type, in order to conduct substantially the entire exhaust gas stream through it/them. For defined securing in the housing and for damming leakage flows, at least one bearing/sealing unit which is constructed, for example, from wire mesh and surrounds the shell in a ring-like manner is provided in the radial intermediate space which is formed between the shell of an exhaust gas treatment unit of this type and the housing.

SUMMARY

It is an object of the present disclosure to provide an exhaust gas treatment arrangement for an exhaust gas system of an internal combustion engine, in the case of which exhaust gas treatment arrangement the occurrence of leakage flows is avoided by way of structurally simple measures.

According to the disclosure, this object is achieved by way of an exhaust gas treatment arrangement for an exhaust gas system of an internal combustion engine, including a housing which is elongated in the direction of a housing longitudinal axis, and at least one exhaust gas treatment unit which is arranged in the housing and has a shell, at least one bearing/sealing unit with at least two bearing/sealing rings which follow one another radially, are nested inside one another and are interrupted in each case in a circumferential interruption region being arranged in a radial intermediate space which is formed between the shell and the housing, a circumferential interruption region of at least one of the bearing/sealing rings being offset in the circumferential direction with regard to a circumferential interruption region of another one of the bearing/sealing rings.

By way of the provision of a plurality of bearing/sealing rings which are interrupted in the circumferential direction, firstly a highly satisfactory adaptation capability of the bearing/sealing unit to the two components which are to be supported with regard to one another and are to be sealed against one another in order to avoid leakage flows is achieved. In particular, unavoidable dimensional tolerances do not impair the functionalities in respect of support and seal. Since the circumferential interruptions, enabling the adaptation capability, of different bearing/sealing rings of a bearing/sealing unit are offset with respect to one another in the circumferential direction, substantially no leakage flows can occur in the circumferential regions either.

In order to obtain an optimum interaction of the bearing/sealing rings of a bearing/sealing unit for a highly satisfactory sealing effect, it is proposed that at least two bearing/sealing rings, preferably all the bearing/sealing rings, of the at least one bearing/sealing unit are of structurally identical configuration with respect to one another.

A highly satisfactory sealing effect can be assisted by virtue of the fact that, in the case of at least two bearing/sealing rings of the at least one bearing/sealing unit, the circumferential interruption regions are offset by approximately 180° with respect to one another in the circumferential direction.

For mechanically stable configuration even under consideration of the thermal load which occurs during operation of an exhaust gas system, at least two bearing/sealing rings, preferably all the bearing/sealing rings, of the at least one bearing/sealing unit can be constructed with metal material.

For this purpose, for example, at least two bearing/sealing rings, preferably all the bearing/sealing rings, of the at least one bearing/sealing unit can be configured as formed metal parts, that is, for example, as what are known as metal bead gaskets.

In order for it to be possible for the radially staggered bearing/sealing rings of a bearing/sealing unit to be nested inside one another satisfactorily for an efficient sealing action, and in order to achieve a substantially gas-tight closure in the process in the mutually bridged circumferential interruption regions, it is proposed that the bearing/sealing rings of the at least one bearing/sealing unit have a substantially U-shaped or substantially V-shaped or substantially W-shaped or substantially M-shaped or substantially wavy cross-sectional profile.

For an efficient sealing effect, in the case of at least one bearing/sealing ring, preferably every bearing/sealing ring, of the at least one bearing/sealing unit, the circumferential interruption region can extend over less than 5%, preferably less than 2%, of the overall circumference of the bearing/sealing ring. For example, a construction can be realized in this way, in the case of which a bearing/sealing ring of this type extends over a circumferential range of from 355° to 359°.

At least one exhaust gas treatment element, preferably a catalytic converter block and/or particulate filter block, can be arranged in the shell of the at least one exhaust gas treatment unit.

Furthermore, the disclosure relates to an exhaust gas system for an internal combustion engine, including at least one exhaust gas treatment arrangement which is constructed according to the disclosure.

BRIEF DESCRIPTION OF DRAWINGS

The invention will now be described with reference to the drawings wherein.

DETAILED DESCRIPTION

Figure 1:
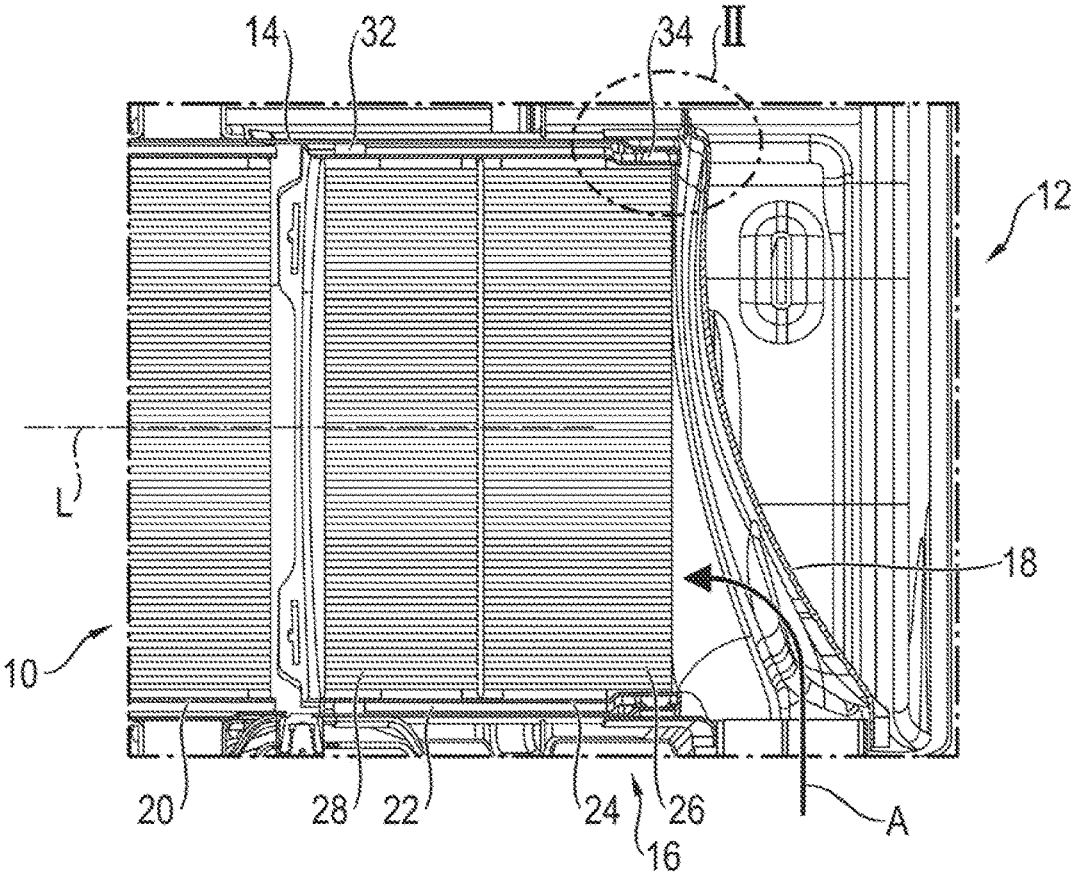
FIG. 1 shows a section of an exhaust gas treatment arrangement in an exhaust gas system for an internal combustion engine with an exhaust gas treatment unit which is inserted into a housing.

FIG. 1 shows an exhaust gas treatment arrangement (denoted in general by 10) of an exhaust gas system 12 for an internal combustion engine, for example in a vehicle. The exhaust gas treatment arrangement 10 includes a tubular housing 14 which is formed, for example, from sheet metal material, is elongated in the direction of a housing longitudinal axis L and has a structure which is as far as possible substantially cylindrical. The housing 14 is adjoined at an upstream end region 16 by a deflection housing which is denoted in general by 18. The latter deflects an exhaust gas stream A, flowing through the exhaust gas system 12, in the direction of the upstream end region 16 of the housing 14.

In the embodiment which is shown, two exhaust gas treatment units 20, 22 are arranged in the housing 14 so as to follow one another axially. As explained in greater detail on the basis of the exhaust gas treatment unit 22, each of these exhaust gas treatment units 20, 22 includes a substantially tubular shell 24 which is constructed, for example, from sheet metal material and in which two exhaust gas treatment elements 26, 28 are arranged so as to follow one another in the exhaust gas flow direction or along the housing longitudinal axis L. Catalytic converters such as, for example, oxidation catalytic converters or SCR catalytic converters, particulate filters or the like can be used as exhaust gas treatment elements 26, 28 of this type. It goes without saying that more than two or else only a single exhaust gas treatment element can be provided in the interior of a shell 24 of this type and can be held therein, for example, by way of a fiber mat or the like which surrounds it.

During the assembly of the exhaust gas treatment arrangement 10, the exhaust gas treatment units 20, 22 which are to be received in the housing 14 are pushed into the housing 14 from the downstream end of this housing 14 in the direction of the housing longitudinal axis L. Here, the exhaust gas treatment unit 22, which is positioned further upstream, can be moved until it comes into contact with a radially inwardly bent-over edge region 30 of the housing 14, by way of which a defined axial position is predefined. In order to also achieve defined radial positioning of the exhaust gas treatment units 20, 22, in particular of the exhaust gas treatment unit 22 which is positioned further upstream, a bearing/sealing unit 32, 34 is provided in at least one axial region, preferably in the two axial end regions of the exhaust gas treatment unit 22, which bearing/sealing unit 32, 34 firstly ensures that the exhaust gas treatment unit 22 is supported in a defined manner in the radial direction with regard to the housing 14, and secondly ensures that the exhaust gas A which flows into the upstream end region 16 of the housing 14 enters substantially completely into the interior of the shell 24 and can therefore be subjected to, for example, a catalytic reaction in the exhaust gas treatment elements, while substantially no exhaust gas flows through an annular intermediate space 36 which is formed between the shell 24 and the housing 14.

One embodiment of a bearing/sealing unit of this type will be described in the following text with reference to the bearing/sealing unit 34 which is positioned further upstream in the case of the exhaust gas treatment unit 22. It goes without saying that the bearing/sealing unit 32 at the further downstream region of the exhaust gas treatment unit 22 might also be constructed in the way which is described in the following text. Bearing/sealing units which, if present, are assigned to a further exhaust gas treatment unit 20 which is arranged in the housing 14 can also be constructed in the way which is described in the following text.

The sealing unit 34 which is provided between the two end sections 38, 40 of the housing 14 or the shell 24 which, for example, are reshaped somewhat radially inward but are nevertheless substantially cylindrical, and surrounds the housing longitudinal axis L or the shell 24 fundamentally in a ring-like manner or over the entire circumference includes two bearing/sealing rings 42, 44 which are arranged so as to follow one another radially with regard to the housing longitudinal axis L and are nested inside one another. The two bearing/sealing rings 42, 44 are of substantially identical configuration to one another and, in the embodiment which is shown, are constructed with a substantially U-shaped cross-sectional geometry. The bearing/sealing rings 42, 44 are preferably configured as formed metal parts from comparatively thin and therefore flexible sheet metal material, for example with a thickness of approximately 0.2 mm, and can be constructed in the manner of what are known as metal bead gasket rings.

Figure 5:
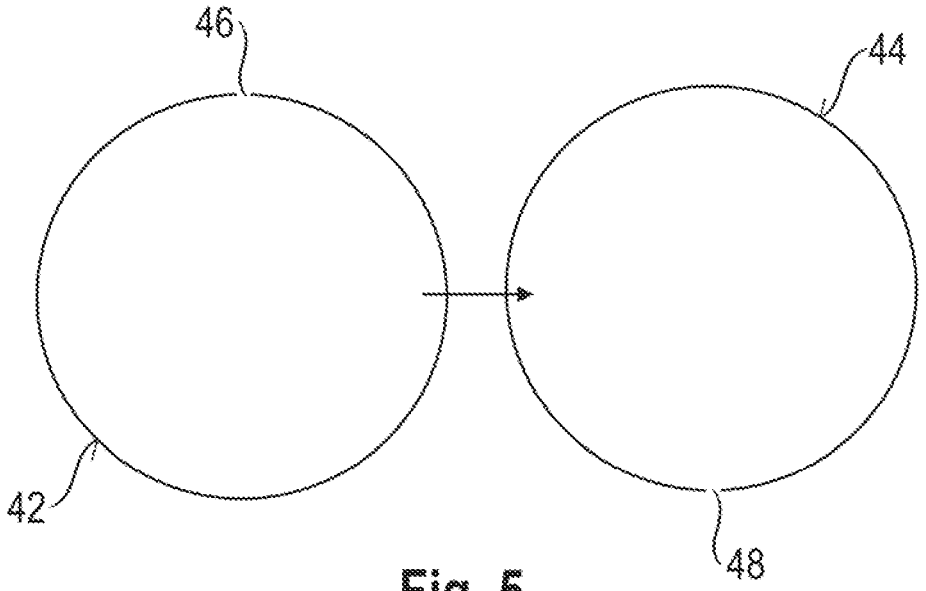
FIG. 5 shows the two bearing/sealing rings of the bearing/sealing unit from FIG. 3 next to one another.
Figure 6:
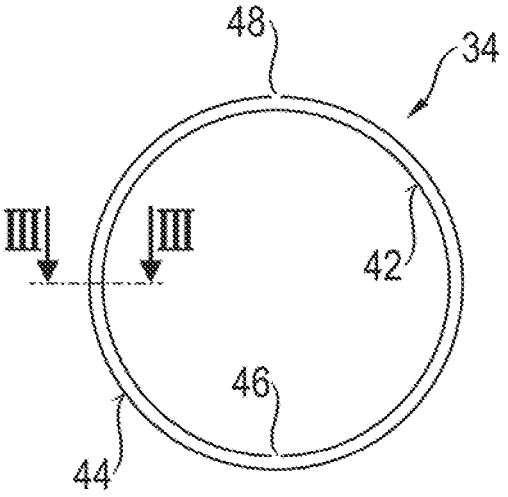
FIG. 6 shows the two bearing/sealing rings from FIG. 5 in an arrangement, in which they are nested inside one another, as considered in the viewing direction VI in FIG. 3; and, FIGS. 7A to 7D show alternative cross-sectional geometries for bearing/sealing rings.

As can be seen on the basis of FIGS. 5 and 6, the two bearing/sealing rings 42, 44 are not configured as rings which are closed in the circumferential direction, that is, extend over a circumferential range of 360°. Each of the two bearing/sealing rings 42, 44 has a circumferential interruption region 46, 48 in a circumferential region and is therefore configured as an open ring. For example, each of the bearing/sealing rings can extend over a circular range in the region from 355° to 359°.

During the assembly of the bearing/sealing unit 34 which includes the two bearing/sealing rings 42, 44, the bearing/sealing rings 42, 44 are positioned or turned with regard to one another in such a way that their circumferential interruption regions 46, 48 lie offset with respect to one another in the circumferential direction. The arrangement is preferably such that the circumferential interruption region 46 of the bearing/sealing ring 42 which is positioned further radially to the inside is offset by approximately 180° with regard to the circumferential interruption region 48 of the bearing/sealing ring 44 which is positioned further radially to the outside, with the result that these two circumferential interruption regions 46, 48 lie substantially diametrically opposite one another with regard to the housing longitudinal axis L.

In the assembled state of the two bearing/sealing rings 42, 44, they lie nested inside one another in such a way that the two U-limbs 50, 52 of the bearing/sealing ring 44 which is positioned further radially to the outside fundamentally bear against the outer side of the two U-limbs 54, 56 of the bearing/sealing ring 42 which is positioned further radially to the inside. The webs 58, 60, which connect the two U-limbs 50, 52 and 54, 56 to one another, of the two bearing/sealing rings 44, 42 can fundamentally be at a slight radial spacing from one another before the assembly of the exhaust gas treatment arrangement 10.

During the assembly and, in particular, during the integration of the bearing/sealing unit 34 of this type into the exhaust gas treatment arrangement 10, the bearing/sealing unit 34 which includes the two bearing/sealing rings 42, 44 which are arranged nested inside one another is pushed onto the end section 40 of the shell 24 before the insertion of the exhaust gas treatment unit 22, in such a way that the free ends of the U-limbs 54, 56 of the bearing/sealing ring 42 which is positioned further radially to the inside lie on the outer side of the shell 24. Afterward, the exhaust gas treatment unit 22 which is fitted with the bearing/sealing unit 34 is pushed into the housing 14. At the latest when the bearing/sealing unit 34 reaches the transition to the radially inwardly offset end section 38 of the housing 14, the bearing/sealing ring 44 which is positioned further radially to the outside comes into contact by way of its web 58 with the inner surface of the housing 14 and is pressed radially inward against the bearing/sealing ring 42 which is positioned further radially to the inside. On account of the bearing/sealing rings 42, 44 which are constructed with a comparatively thin material and are therefore flexible, they can deform slightly during loading of this type, with the result that firstly the two bearing/sealing rings 42, 44 are pressed radially against one another, and secondly they are pressed against the housing 14 or the shell 24 and therefore firstly provide a defined radial retaining action for the exhaust gas treatment unit 22 substantially over the entire circumference, and secondly produce a substantially gas-tight termination of the intermediate space 36.

On account of the circumstance that the two circumferential interruption regions 46, 48 lie offset with respect to one another and the bearing/sealing rings 42, 44 therefore bridge one another mutually in these circumferential interruption regions 46, 48, a substantially gas-tight closure of the intermediate space 36 is also ensured in these circumferential interruption regions 46, 48. This is also contributed to, in particular, by the fact that the two bearing/sealing rings 42, 44 are not completely rigid, but rather deform as a result of the radial loading exerted via the housing 14 and the shell 24 and can therefore be adapted to their outer circumferential contour or inner circumferential contour. In this way, in particular, shape tolerances or dimensional tolerances of the housing 14 or the exhaust gas treatment unit 22 can also be compensated for, as can variations in the radial spacing between them which are generated by way of thermal expansion of these components.

The use of a bearing/sealing unit 34 of this type with two bearing/sealing rings 42, 44 made from a comparatively thin-walled and therefore readily deformable metal material ensures firstly that a sealed termination which as far as possible rules out leakage flows is realized, in particular, in the upstream end region of the housing 14 in the case of a comparatively low resistance during pushing of the exhaust gas treatment unit 22 into the housing 14 on account of the shape adaptability of the bearing/sealing unit 34. Since bearing/sealing rings 42, 44 of identical construction to one another can be used for the bearing/sealing unit 34, it can be produced with a minimum number of components which are different or are of different configuration, and it is dimensionally stable, in particular, even under the influence of temperature and, in the case of temperature changes, can adapt to shape changes, triggered as a result, of the components which are to be sealed with respect to one another.

Since the occurrence of leakage flows is practically ruled out by way of the use of a bearing/sealing unit 34 of this type, in particular, in the upstream end region of the exhaust gas treatment unit 22 or the housing 14 which receives the latter, and the exhaust gas A which is to be purified of pollutants therefore flows substantially completely through the interior of the shell 24 and therefore through the exhaust gas treatment elements or element 26, 28 arranged therein, a different construction which is possibly less expensive or simpler to realize can be selected, for example, for the bearing/sealing unit 32, which construction does not necessarily have to ensure the same extent of tightness. If a further exhaust gas treatment unit 20 follows the exhaust gas treatment unit 22 downstream, this further exhaust gas treatment unit might also be supported and sealed in its upstream end region by way of a bearing/sealing unit with regard to the housing 14, which bearing/sealing unit corresponds with regard to its construction to the bearing/sealing unit 34.

It is to be noted that a very wide variety of variations are possible in the embodiment of a bearing/sealing unit 34 of this type. For example, more than two bearing/sealing rings might also be arranged nested inside one another, which can be advantageous, in particular, when the radial intermediate space 36 which is formed between the shell 24 and the housing 14 has a comparatively great radial extent. If more than two bearing/sealing rings are used, it can be provided in order to obtain an efficient sealing effect that the circumferential spacing of the circumferential interruption regions of the bearing/sealing rings corresponds to an angular spacing which corresponds to the division of 360° by the number of bearing/sealing rings which are used. In the case of three bearing/sealing rings in a bearing/sealing unit, the circumferential spacing of the circumferential interruption regions can therefore lie in the region of 120°. In the case of four bearing/sealing rings in a bearing/sealing unit, this circumferential spacing of the circumferential interruption regions can therefore lie in the region of 90°.

Figure 2:
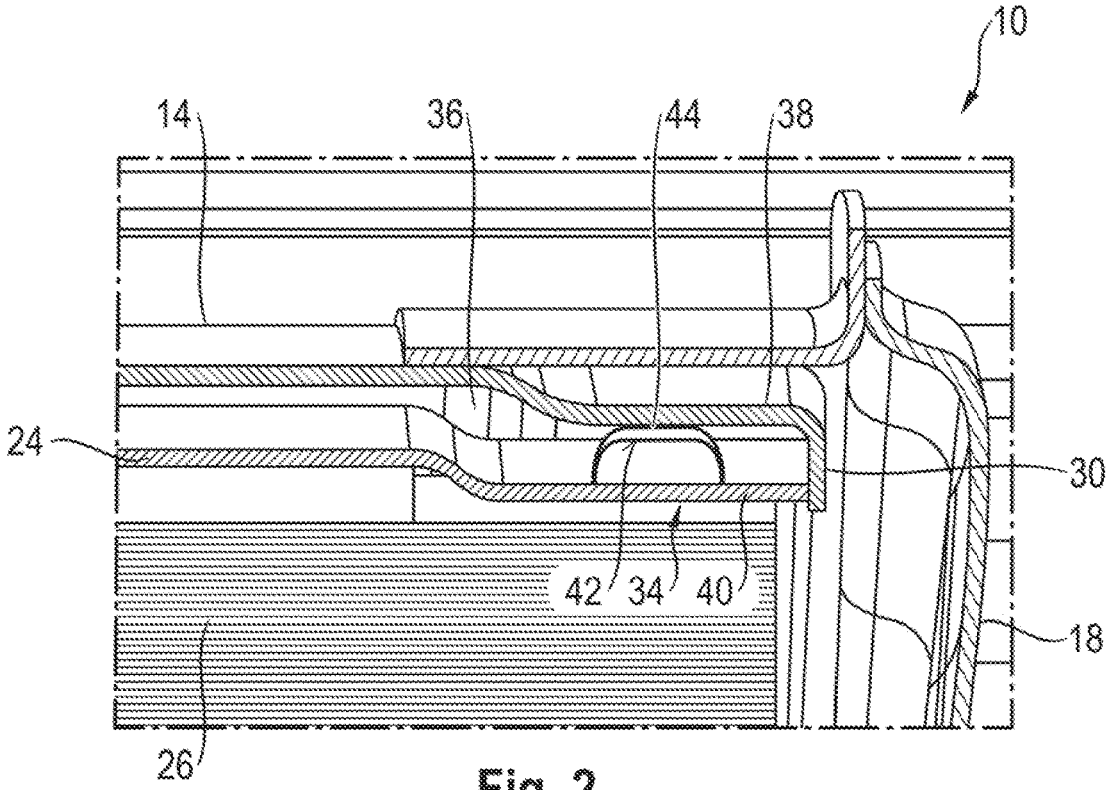
FIG. 2 shows the detail II from FIG. 1 on an enlarged scale.
Figure 3:
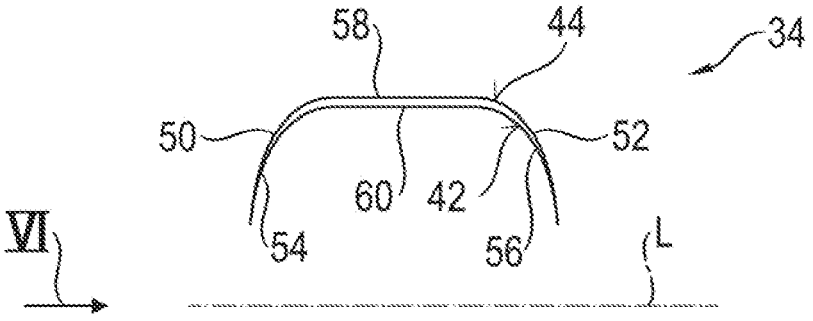
FIG. 3 shows an outline illustration of a bearing/sealing unit which is used in the case of the exhaust gas treatment arrangement from FIG. 1 and has two bearing/sealing rings which follow one another radially and are nested inside one another in the viewing direction III-III in FIG. 6.
Figure 4:
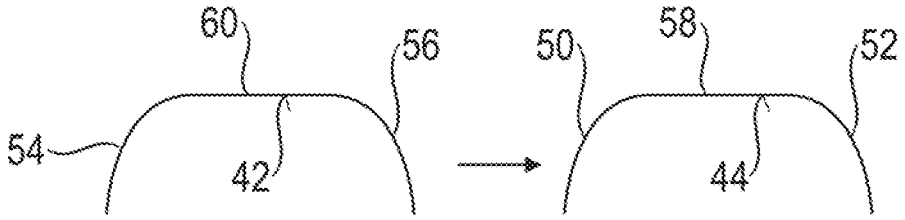
FIG. 4 shows the two bearing/sealing rings of the sealing unit from FIG. 3 next to one another.
Figure 7A:
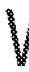
Figure 7B:
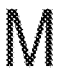
Figure 7C:
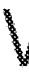
Figure 7D:
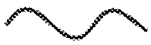

The bearing/sealing rings of a bearing/sealing unit of this type can also have different cross-sectional geometries than the U-shaped cross-sectional geometry which can be seen in FIGS. 2 to 4. Examples for this are shown in FIGS. 7A to 7D. For example, the bearing/sealing rings which are used in the case of a bearing/sealing unit 34 of this type can be configured with a D-shaped cross-sectional geometry, in the case of which the free ends of the two outer W-limbs can be oriented radially outward just like the connecting region which lies between them, while the two connecting regions which can be seen at the bottom in FIG. 7A) can be oriented radially inward. As shown in FIG. 7B), an M-shaped cross-sectional geometry of the bearing/sealing rings is also possible which substantially reverses the allocation of the supporting regions with respect to the housing 14 and with respect to the shell 24 in comparison with the W-shaped configuration. A fundamentally V-shaped configuration which is shown in FIG. 7C) is also possible, it also being possible here for the two free ends of the V-limbs to be oriented either further radially outward or radially inward. Finally, FIG. 7B) shows a generally wavy cross-sectional geometry of a bearing/sealing ring of this type, in the case of which wave peaks which are supported in an alternating manner radially to the outside and radially to the inside follow one another in the axial direction. Here, the number of radially outwardly and radially inwardly supported wave peaks can be identical, or, for example, more wave peaks can be supported radially to the outside and radially to the inside, or vice versa.

It is understood that the foregoing description is that of the preferred embodiments of the invention and that various changes and modifications may be made thereto without departing from the spirit and scope of the invention as defined in the appended claims.

The invention claimed is:

1. An exhaust gas treatment arrangement for an exhaust gas system of an internal combustion engine, the exhaust gas treatment arrangement comprising:

a housing defining a longitudinal axis and being elongated in a direction along said longitudinal axis;

at least one exhaust gas treatment unit arranged in said housing and having a shell;

said housing and said shell conjointly defining an intermediate space therebetween;

at least one bearing/sealing unit disposed in said intermediate space;

said at least one bearing/sealing unit having at least two bearing/sealing rings disposed radially one behind the other so as to be nested inside one another, each of said bearing/sealing rings being configured as a formed sheet metal part;

each of said bearing/sealing rings being configured as an open ring interrupted in a circumferential interruption region; and, the circumferential interruption region of at least one of said bearing/sealing rings being offset in a circumferential direction with respect to the circumferential interruption region of another one of said bearing/sealing rings.

2. The exhaust gas treatment arrangement of claim 1, wherein said at least two bearing/sealing rings are of mutually structurally identical configuration.

3. The exhaust gas treatment arrangement of claim 1, wherein said circumferential interruption regions of corresponding ones of said at least two bearing/sealing rings are offset by approximately 180° with respect to one another in said circumferential direction.

4. The exhaust gas treatment arrangement of claim 1, wherein said at least two bearing/sealing rings of said at least one bearing/sealing unit are configured to have one of the shapes:

i) a U-shape;

ii) a V-shape;

iii) a W-shape;

iv) an M-shape; and, v) a wavy cross-sectional profile.

5. The exhaust gas treatment arrangement of claim 1, wherein the circumferential interruption region of at least one of said bearing/sealing rings of said at least one bearing/sealing unit extends over less than 5% of the overall circumference of the bearing/sealing ring.

6. The exhaust gas treatment arrangement of claim 1, wherein the circumferential interruption region of at least one of said bearing/sealing rings of said at least one bearing/sealing unit extends over less than 2% of the overall circumference of the bearing/sealing ring.

7. The exhaust gas treatment arrangement of claim 1 further comprising at least one further exhaust gas treatment unit of at least one of the following configurations arranged in said shell: i) a catalytic converter block; and, ii) a particulate filter block.

8. The exhaust gas treatment arrangement of claim 1, wherein each of said bearing/sealing rings has a U-shaped cross-sectional profile with a web connecting two U-limbs, the U-limbs of a bearing/sealing ring of said bearing/sealing rings positioned further radially to the outside bear against the outer side of the U-limbs of a bearing/sealing ring of said bearing/sealing rings positioned further radially to the inside.

9. An exhaust gas system for an internal combustion engine, the exhaust gas system comprising:

a deflection member for deflecting an exhaust gas stream flowing through said exhaust gas system;

at least one exhaust gas treatment arrangement which includes:

a housing defining a longitudinal axis and being elongated in a direction along said longitudinal axis;

said housing having an upstream end region adjoining said deflection member;

at least one exhaust gas treatment unit arranged in said housing and having a shell;

said housing and said shell conjointly defining an intermediate space therebetween;

at least one bearing/sealing unit disposed in said intermediate space;

said at least one bearing/sealing unit having at least two bearing/sealing rings disposed radially one behind the other so as to be nested inside one another, each of said bearing/sealing rings being configured as a formed sheet metal part;

each of said bearing/sealing rings being configured as an open ring interrupted in a circumferential interruption region; and, the circumferential interruption region of at least one of said bearing/sealing rings being offset in a circumferential direction with respect to the circumferential interruption region of another one of said bearing/sealing rings.

10. The exhaust gas system of claim 9, wherein each of said bearing/sealing rings has a U-shaped cross-sectional profile with a web connecting two U-limbs, the U-limbs of a bearing/sealing ring of said bearing/sealing rings positioned further radially to the outside bear against the outer side of the U-limbs of a bearing/sealing ring of said bearing/sealing rings positioned further radially to the inside.

* * * * *